US005107971A

United States Patent [19]

Freeman

[11] Patent Number: 5,107,971

[45] Date of Patent: Apr. 28, 1992

[54] PROTECTIVE LUGGAGE SHELL

[76] Inventor: Eva A. Freeman, 13716 Brynwood La., Fort Myers, Fla. 33912

[21] Appl. No.: 763,555

[22] Filed: Sep. 23, 1991

[51] Int. Cl.[5] ..... A45C 3/08; A45C 13/38

[52] U.S. Cl. ..... 190/26; 190/108; 190/125; 150/105

[58] Field of Search ..... 190/26, 108, 110, 125; 224/42.01; 206/292; 150/103-105

[56] References Cited

U.S. PATENT DOCUMENTS

| | | | |
|---|---|---|---|
| 2,422,511 | 6/1947 | Wolsey | 206/292 |
| 2,532,154 | 11/1950 | Duskin | 190/26 |
| 2,617,504 | 11/1952 | Meyers | 190/26 |
| 2,723,734 | 11/1955 | Bellamy | 190/110 |
| 2,724,467 | 11/1955 | Jaffe | 190/26 |
| 3,209,971 | 10/1965 | Goodell | 190/108 X |
| 3,452,846 | 7/1969 | Joachim | 190/108 |
| 3,623,580 | 11/1971 | Toller | 190/125 X |
| 3,861,504 | 1/1975 | McGraw | 190/108 X |
| 3,901,360 | 8/1975 | Cook | 190/26 |
| 4,953,674 | 9/1990 | Landes | 190/26 X |

FOREIGN PATENT DOCUMENTS

| | | | |
|---|---|---|---|
| 2484221 | 12/1981 | France | 190/108 |
| 556026 | 11/1958 | Italy | 206/292 |
| 7900583 | 8/1979 | PCT Int'l Appl. | 190/108 |
| 389678 | 3/1933 | United Kingdom | 190/26 |
| 2167656 | 6/1986 | United Kingdom | 190/26 |

*Primary Examiner*—Sue A. Weaver
*Attorney, Agent, or Firm*—William E. Noonan

[57] ABSTRACT

A protective shell is provided for a piece of luggage. The shell includes a pair of substantially rigid, transparent shell sections, each having an interior space, which at least partly accommodates the piece of luggage. The shell sections are pivotably interconnected such that they are pivotable between an open condition to expose the interior space of each shell section and a closed condition to define an enclosure about the interior spaces for accommodating the piece of luggage therein. The shell sections are provisionally fastened in the closed condition and include a slot that receives the handle of the piece of luggage such that both the luggage and the shell may be carried by a person using the shell.

11 Claims, 4 Drawing Sheets

PROTECTIVE LUGGAGE SHELL

FIELD OF THE INVENTION

This invention relates to a protective luggage shell and, more particularly, to a rugged, transparent enclosure for accommodating and protecting luggage during travel.

BACKGROUND OF THE INVENTION

Suitcases, bags and other types of luggage are typically subjected to considerable abuse and rough handling during travel. For example, luggage may be casually handled by many different persons other than its owner, including skycaps, airline baggage handlers, cab and bus drivers and bellhops. Additionally, travel bags are often moved by conveyers and other mechanical freight handlers and such items may be stored and transported in various types of vehicle trunks and cargo holds. Under these circumstances, most luggage is likely to be dropped, jostled and impacted by other items repeatedly during a trip. As a result of this rough treatment the luggage eventually becomes soiled and accumulates a multitude of scratches, scuffs and other marks. This obviously detracts from the appearance of, and otherwise damages the luggage, which is usually quite costly to repair or replace. In an attempt to address this problem, a number of luggage protectors have been developed. To date, these protectors typically utilize a flexible plastic or fabric material that does not adequately prevent damage to the bag from human and mechanical sources. It is also usually quite awkward and time consuming to remove such protectors from the luggage. This presents a serious inconvenience when baggage inspection is required, such as at airport customs gates. Furthermore, conventional luggage protectors are constructed from a generally opaque material, which obscures the suitcase or bag. This defeats the entire purpose of using an ornamentally attractive and aesthetically pleasing piece of luggage. Moreover, bags protected by opaque covers are more likely to be overlooked or confused in a hectic airport or bus terminal.

SUMMARY OF THE INVENTION

It is therefore an object of this invention to provide a rugged and durable luggage shell that offers increased protection to luggage against soiling, cuts, scratches, water, scuffs and other damage.

It is a further object of this invention to provide a luggage shell that effectively protects a piece of luggage and at the same time allows the luggage to be viewed clearly within the shell.

It is a further object of this invention to provide a protective luggage shell that allows luggage to be quickly identified and that does not hinder or obscure the ornamental appearance of the luggage.

It is a further object of this invention to provide a protective luggage shell that may be quickly and conveniently opened and removed for inspection of the accommodated luggage.

It is a further object of this invention to provide a protective luggage shell that allows the user to employ the handle or strap provided on the luggage in order to carry both the luggage and the shell.

It is a further object of this invention to provide a protective luggage shell that discourages theft of items carried by the luggage.

It is a further object of this invention to provide a protective luggage shell that accommodates luggage having a wide variety of shapes and sizes.

This invention features a protective shell for a piece of luggage. The shell includes a pair of substantially rigid, transparent shell sections, each having an interior space which at least partly accommodates the piece of luggage. There are means for pivotably interconnecting the shell sections such that they are pivotable between an open condition to expose the interior space of each shell section and a closed condition to define an enclosure about the interior spaces for accommodating the piece of luggage therein. There are means for provisionally fastening the shell sections in the closed condition. Means are also provided for adapting the shell to be carried by the person using the shell.

In a preferred embodiment, wherein the piece of luggage has a carrying handle attached thereto, the means for adapting include slot means formed in at least one of the shell sections for receiving the handle therethrough such that the handle is accessible to the person using the shell. In embodiments wherein the piece of luggage includes a shoulder strap, the means for adapting may include first and second spaced apart openings, each of which is formed in at least one of the shell sections for receiving a respective segment of the strap therethrough such that the strap is accessible to the person using the shell. Typically, each shell section comprises a unitary structure.

Each of the transparent shell sections preferably includes a relatively broad side portion and elongate top, bottom, front and rear portions, which are attached to and extend longitudinally about the periphery of the side portion. The top, bottom, front and rear portions may extend laterally in a transverse direction from the side portion to define the interior space of the shell section. The means for pivotably interconnecting may interconnect respective bottom portions of the shell sections. When the shell sections are pivoted into the open condition, the top, front and rear portions of the first shell section are preferably disengaged from the top, front and rear portions, respectively, of the second shell section. When the shell sections are pivoted to the closed condition the top, front and rear portions of the first shell section are preferably engaged with the top, front and rear portions, respectively, of the second shell section. Each shell section may include a unitary structure wherein the side, top, bottom, front and rear portions are integrally interconnected.

Preferably, the slot means include a first recessed portion formed in the top portion of the first shell section and a second, complementary recessed portion formed in the top portion of the second shell section, which recessed portions are interengaged when the shell sections are enclosed. Alternatively, slot means may be formed exclusively in one of the top portions. A first opening may be formed in at least one of the top portions proximate a first end thereof and a second opening may be formed in at least one of the top portions proximate a second end thereof. The openings receive therethrough respective segments of a luggage carrying strap. Each of the first and second openings may include a primary recessed portion formed in the top portion of the first shell section and a complementary secondary recessed portion formed in the top portion of the second shell section. Such primary and secondary recessed sections are interengaged when the shell sections are closed.

The means for adapting may alternatively include a handle that is attached to at least one of the shell sections.

DISCLOSURE OF PREFERRED EMBODIMENT

Other objects, features and advantages will occur from the following description of a preferred embodiment and the accompanying drawings in which.

Figure 1:
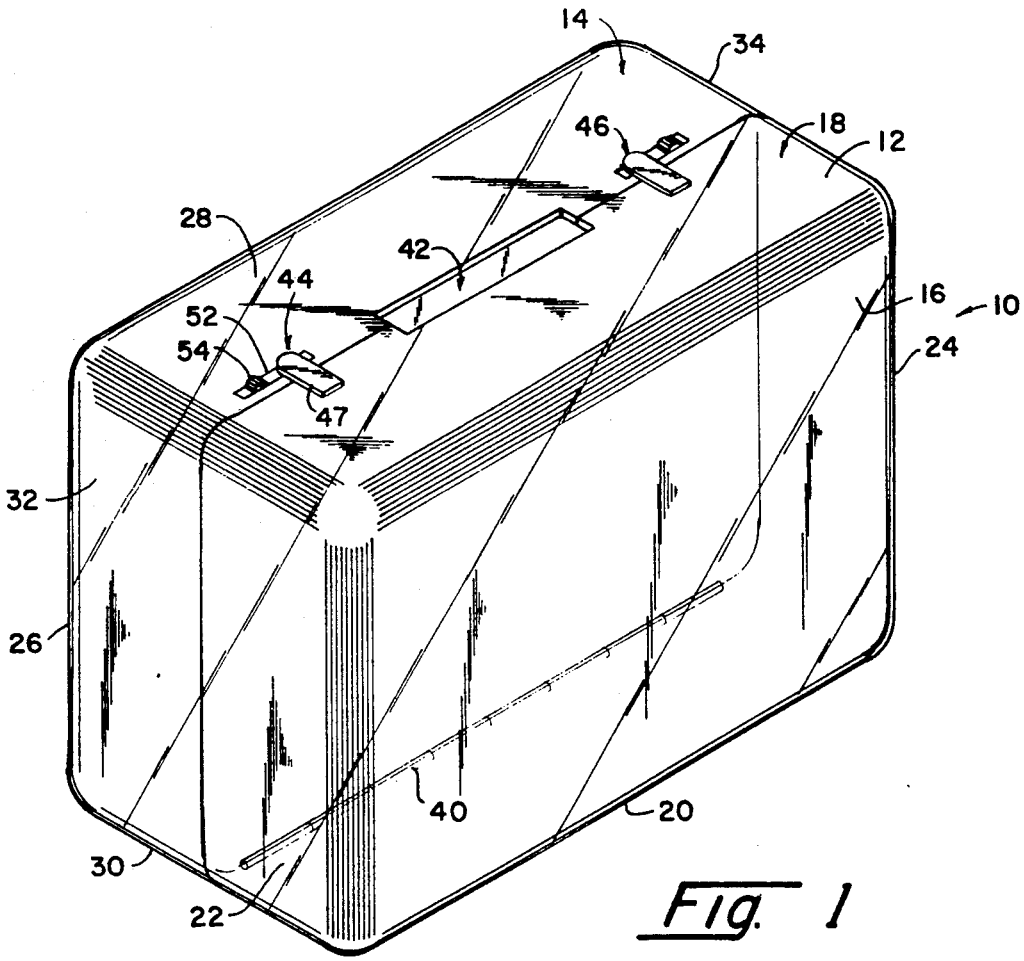
FIG. 1 is a perspective view of one preferred protective luggage shell in accordance with this invention, which shell is in a closed condition.

A protective luggage shell according to this invention is constructed by pivotably interconnecting a pair of substantially rigid, transparent shell sections, each of which defines an interior space for at least partially accommodating a piece of luggage. Each such shell section typically includes a relatively broad side portion and elongate top, bottom, front and rear portions, which longitudinally surround the side portion and extend laterally therefrom. The top, bottom, front and rear portions are preferably integrally joined to the side portion such that each shell section comprises a unitary member. The corners of each shell section may be somewhat curved or rounded. Alternatively, sharp corners may be exhibited. Rounded corners are less likely to catch or dig surrounding luggage and may provide a more aesthetically pleasing appearance. Sharper corners may permit the luggage shell to stand more stably on its own.

The shell sections are preferably formed from a molded or extruded plastic material. It is of critical importance that the material employed for the shell sections be durable, rigid and transparent. Each shell section should have self-sustaining shape and should not collapse if it is stood up on its own. A preferred material for the shell sections is poylymethyl methacrylate, which is extremely rugged and exhibits light transmission of approximately 92%. A variety of other tough, transparent plastics may also be employed. Such materials include Lexan (TM) and Plexiglas DR (TM) acrylic. The material must be highly resistent to typical travel impacts so that the protected luggage is not damaged during normal shipment and use. It should also be waterproof and resistant to weather damage. At the same time, it must be sufficiently transparent so that the natural attractiveness of the luggage is plainly evident through the material.

Preferably the shell sections are connected by one or more of a variety of pivots or hinges, such as a piano hinge. Various other types of hinges or pivots known in the luggage art may also be utilized. This allows the shell sections to be pivotably opened and closed, as required.

The shell sections are fastened in the closed condition by one or more of a variety of latches or clasps known to those skilled in the art. Such latches, as well as the pivots or hinges, are preferably composed of brass or some other suitable metal or metal alloy. A preferred latch employs a spring that urges the latch open when an appropriate lever or button is activated. Such fasteners hold the shell sections securely and provisionally closed to fully protect the luggage during transport. At the same time, the fasteners should be opened with a minimum of manipulation so that the accommodated luggage can be readily removed for inspection, such as at an airport terminal or customs gate.

An additional feature of this shell is that it permits the piece of luggage and the shell itself to be carried by means of the conventional handle or strap provided on the luggage. This is accomplished by a slot provided in one or more of the top portions of the shell for receiving the handle. A pair of openings may also be provided in one or more of the top portions proximate the front and rear portions of the shell for accommodating respective segments of a carrying strap. As a result, the user or other persons may conveniently carry the luggage while it remains protected by the shell. Preferably, the shell is relatively lightweight so that such carrying is not unduly burdensome.

The rigid, transparent shell disclosed by this invention provides much improved protection for conventional luggage. The luggage is capable of withstanding considerable abuse at airports and bus terminals, and in vehicles. As a result, the life of expensive and attractive baggage is increased considerably. The rigid shell is also much more readily removable from the luggage than conventional, flexible canvas luggage protectors. Accordingly, delays for baggage inspection are reduced considerably.

The shell also provides for improved theft protection. When the shell is closed and locked, it will tend to discourage dishonest individuals from attempting to break into the enclosed luggage.

In certain embodiments the handle and strap accommodating openings may be eliminated and a permanent handle may be attached to one or both of the shell sections. This protects the luggage even further against possible water damage.

Figure 2:
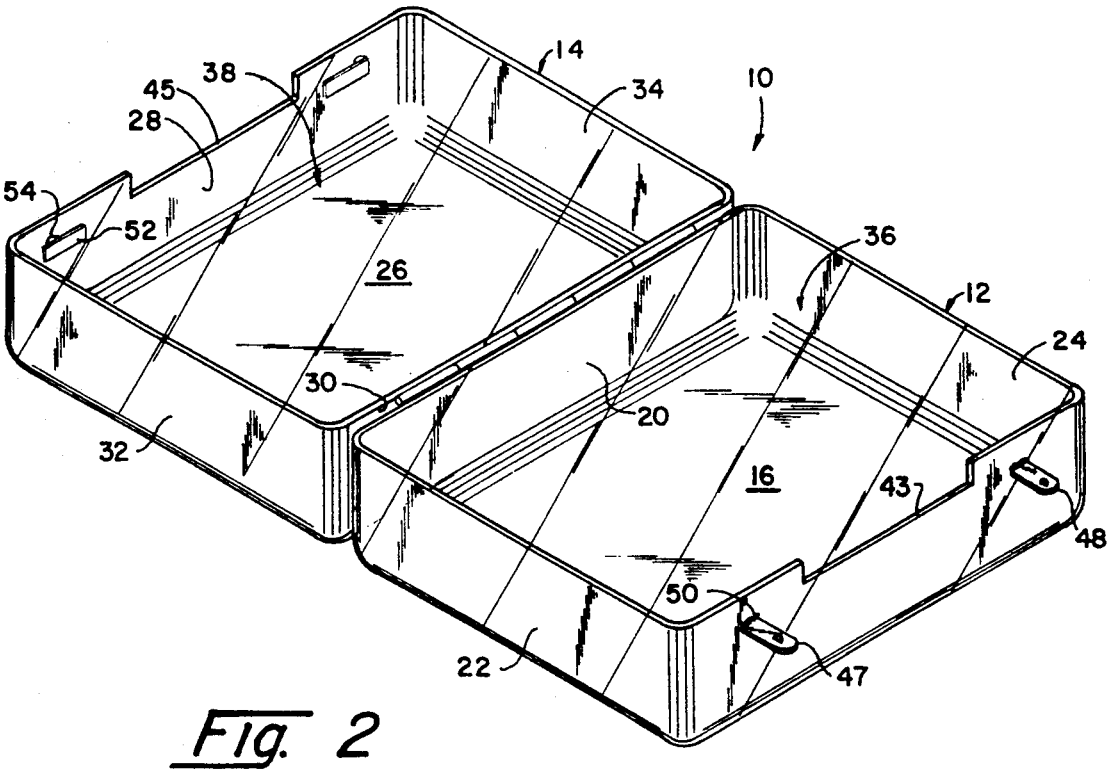
FIG. 2 is a perspective view of the luggage shell of FIG. 1 in an open condition.

There is shown in FIGS. 1 and 2 a protective luggage shell 10 that includes a pair of pivotably interconnected shell sections 12 and 14. Each of the shell sections comprises a molded unitary member composed of a substantially rigid, transparent plastic material such as Lexan (TM) or the like. More particularly, shell section 12 includes a relatively broad side portion 16, top and bottom portions 18 and 20 and front and rear portions 22 and 24, respectively. Similarly, shell section 14 includes a relatively broad side portion 26, top and bottom portions 28 and 30 and front and rear portions 32 and 34. Top and bottom portions 18 and 20, and front and rear portions 22 and 24 extend longitudinally about the periphery of side portion 16 and extend laterally therefrom such that shell section 12 defines an interior space 36, shown in FIG. 2. Likewise, the top and bottom portions 28 and 30, and front and rear portions 32 and 34 extend longitudinally about the periphery of said portion 26 and extend laterally therefrom such that shell section 14 defines an interior space 38.

Shell sections 12 and 14 ar pivotably interconnected by a hinge element 40, which allows the shell sections to pivot between the closed condition shown in FIG. 1 and the open condition shown in FIG. 2. More particularly, hinge element 40 interconnects the bottom portion 20 of shell section 12 and the bottom portion 30 of shell section 14. Although hinge 40 is shown extending along the entire length of bottom portions 20 and 30, this is not a limitation of the invention as the hinge may extend only partially along the length of the bottom portions and a plurality of discrete hinge portions may be utilized.

In the closed condition shown in FIG. 1, top portion 18 of shell section 12 engages top portion 28 of shell section 14. Likewise, front portion 22 of section 12 engages front portion 32 of section 14, and rear portion 24 of section 12 engages rear portion 34 of section 14. As a result, shell sections 12 and 14 define an enclosure for accommodating a piece of luggage in a manner described more fully below. When shell 10 is opened, as shown in FIG. 2, the respective top, front and rear portions are disengaged such that the interior spaces 36 and 38 are exposed.

An elongate slot 42 is formed in top portions 18 and 28 of shell sections 12 and 14, respectively. As further shown in FIG. 2, slot 42 is defined by a first recess 43 formed in top portion 18 and a second complementary recess 45 formed in top portion 28. This slot receives a conventional luggage handle in a manner described more fully below.

A pair of latches 44 and 46 are utilized to provisionally fasten together shell sections 12 and 14 in the closed condition. Latches 44 and 46 comprise conventional fastening means that are found in the luggage art. More particularly, latch 44 includes a first element 47 that is pivotably mounted to top portion 18 of shell section 12. A spring 50 urges member 47 into the open condition shown in FIG. 2. When shell 10 is closed, as shown in FIG. 1, spring 50 allows member 47 to pivot so that it engages and locks with a complementary, conventional latch receptacle 52. To open latch 44, the user engages a button 54 located adjacent to receptacle 52 and slides it toward the front portion 32. This releases member 47 from receptacle 52. As a result, spring 50 urges member 47 into the open condition shown in FIG. 2. Latch 46, featuring a spring actuated element 48, is constructed and operates in an identical manner so that the shell sections may be selectively fastened and unfastened for closing and opening the shell. In other embodiments alternative numbers and types of releasible fasteners may be employed.

A conventional locking mechanism, similar to a suitcase or luggage lock, may be provided for each of the fasteners. This allows the latches to be locked closed. A key, tumblers or other known means may be utilized to unlock the latches.

Figure 3:
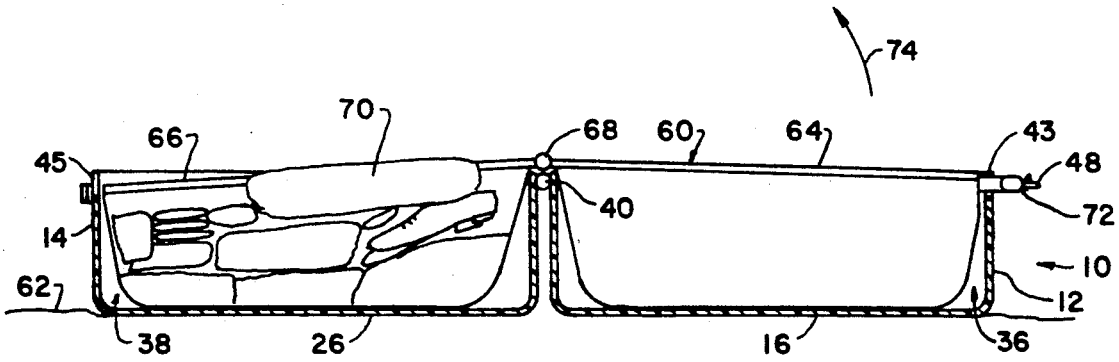
FIG. 3 is a cross-sectional view of the luggage shell of FIGS. 1 and 2 in an open condition with an open suitcase received therein.
Figure 4:
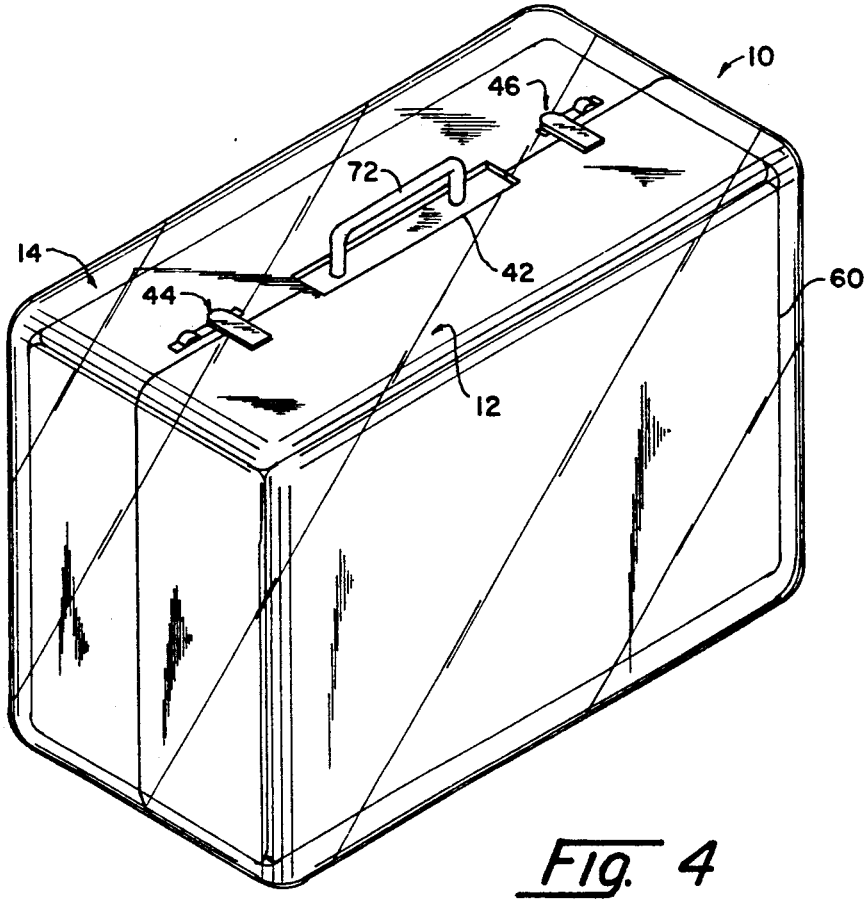
FIG. 4 is a perspective view of the closed luggage shell of FIG. 1 with a piece of luggage accommodated therein.

Shell 10 is opened in the manner shown in FIG. 3 to receive a suitcase 60. In particular, shell sections 12 and 14 are pivoted into the open condition such that respective side portions 16 and 26 rest upon a bed or other generally flat surface 62. Suitcase 60 is opened and placed in shell 10 such that suitcase section 64 is received by interior space 36 of shell section 12 and suitcase section 66 is received by interior space 38 of shell section 14. The hinge or pivot means 68 interconnecting the suitcase sections 64 and 66 is located above and generally in alignment with hinge 40 of shell 10. Suitcase 60 is opened in this manner for receiving clothes and other items 70. Such items are packed into, for example, section 66. When packing is completed, suitcase section 64 is pivoted in the direction of arrow 74 until it engages suitcase section 66 to close the suitcase. The luggage is then locked or fastened in a conventional manner. When this is completed, the shell section 12 is pivoted closed in the direction of arrow 74 and suitcase handle 72 is manipulated to extend through slot 42. Latches 44 and 46 are then closed to fasten the shell closed, as shown in FIG. 4. As illustrated therein, the luggage handle 72 conveniently extends through slot 42 and the suitcase is plainly visible through the transparent plastic shell 10. By grasping handle 72, the user is able to carry both suitcase 60 and shell 10.

During transport of suitcase 60, shell 10 provides protection against a wide variety of impact and weather damage. If locked closed, as described above, the shell complicates breaking into suitcase 60 and therefore, provides a theft deterrent to potentially dishonest individuals who handle the luggage.

Figure 5:
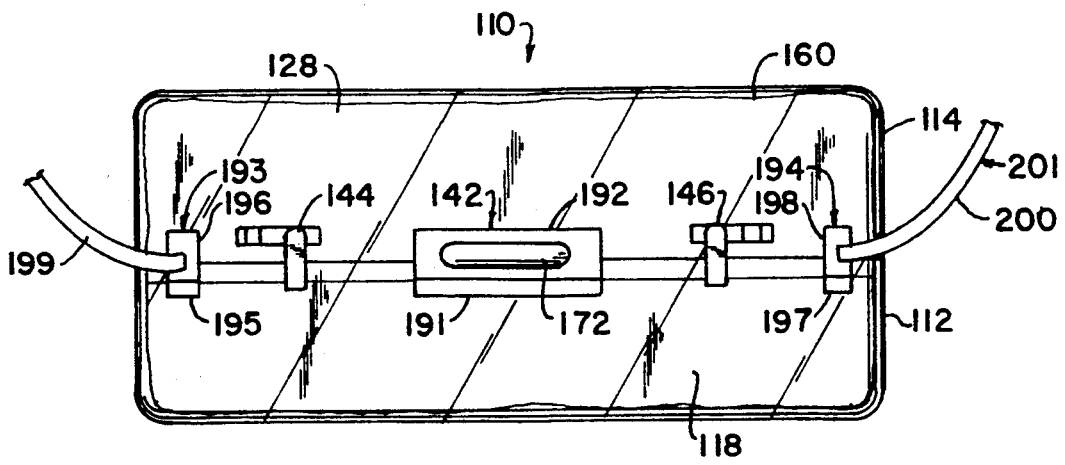
FIG. 5 is a plan view of an alternative preferred luggage shell in accordance with this invention.
Figure 6:
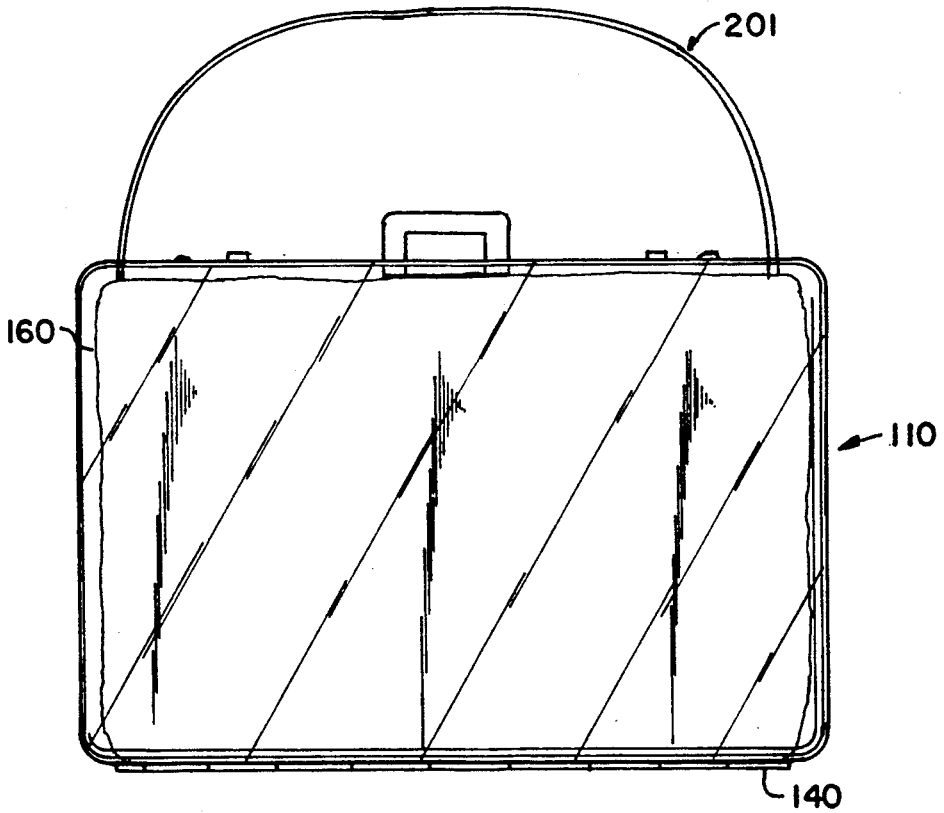
FIG. 6 is a side elevational view of the luggage shell of FIG. 5.

An alternative protective luggage shell 110 is shown in FIGS. 5 and 6. Shell 110 includes half shell sections 112 and 114 that generally resemble the shell sections of the previously described embodiment. In particular, the shell sections are formed from a rigid, trans-parent plastic material and are interconnected by a hinge 140. Releasable latches 144 and 146 are provided for fastening the shell sections in the closed condition.

A slot 142 is formed in both of the top portions 118 and 128. More particularly, portion 118 includes a recessed portion 191 formed along the edge thereof. Top portion 128 includes a similarly shaped, complementary recessed portion 192 formed along its edge. When the shell sections 112 and 114 are engaged in the closed condition, shown in FIG. 5, recessed portions 191 and 192 are interengaged to form a generally centrally located, elongate slot 142 for receiving the handle 172 of a piece of luggage 160 accommodated within shell 110.

Shell 110 also includes a pair of openings 193 and 194 that are formed at opposite ends of the top portions 118 and 128 of respective shell sections 112 and 114. More particularly, opening 193 includes a primary recessed portion 195 that is formed in top portion 118 and a secondary recessed portion 196 that is formed in top portion 128. Similarly, opening 194 includes a primary recessed portion 197 that is formed in top portion 118 and a secondary recessed portion 198 that is formed in top portion 128. When the shell sections 112 and 114 are interengaged in the closed condition, primary and secondary recessed portions 195 and 196 are interengaged to form opening 193. Likewise, when the shell sections are closed, primary and secondary recessed portions 197 and 198 are interengaged to form opening 194. Openings 193 and 194 accommodate respective segments 199 and 200 of a shoulder strap 201, FIGS. 5 and 6, that is attached to luggage 160. This allows the user to carry both luggage 160 and shell 110 by means of the shoulder strap. The strap may be engaged with the openings before the shell is closed. Or, if one or both of the ends of the strap are detachable from the bag, it can be inserted through the opening and attached to the bag after the shell is closed.

The shoulder strap openings and slots formed in the top of the protective shell may be arranged at alternative locations in the shell so that various other luggage designs may be conveniently carried.

Figure 7:
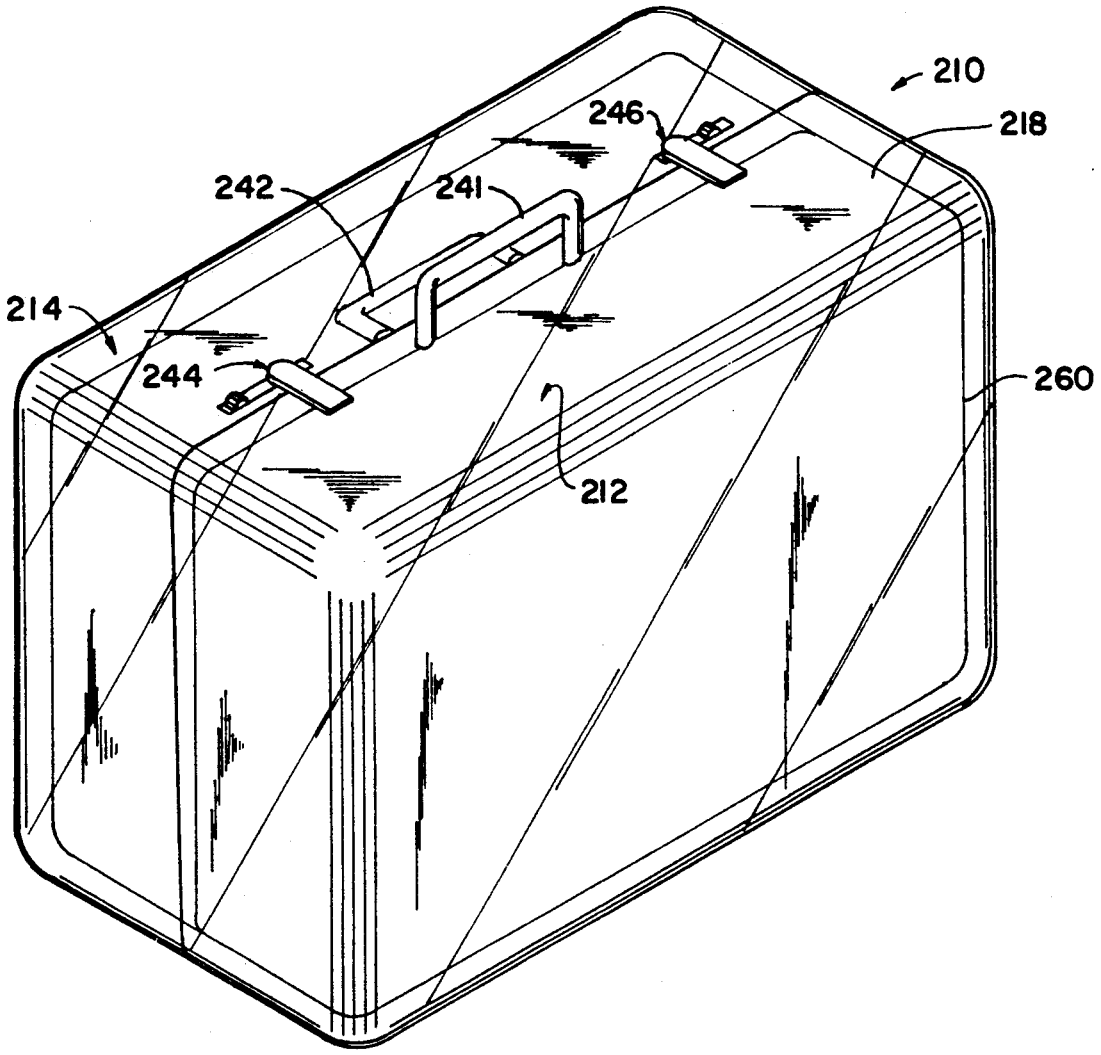
FIG. 7 is a perspective view of a further alternative preferred luggage shell in accordance with this invention.

A further alternative embodiment is shown in FIG. 7. Therein shell 210 includes half sections 212 and 214 that are closed flush along their respective edges and selectively locked by latches 244 and 246. Unlike the previous embodiments, a handle accommodating opening is not formed in the upper portions of the shell sections. Instead, a handle 241 is permanently attached to shell 210 such as to top portion 218 of section 212. The handle 242 of suitcase 260 folds down against the suitcase or is otherwise disposed with the luggage within the shell. The handle may alternatively include two handle sections, each of which is connected to a respective shell section. The handle may be attached either fixedly or foldably to the shell.

Shell 210 is particularly effective in providing a watertight seal for the accommodated luggage. Because the handle accommodating opening is eliminated, water intrusion is reduced considerably and the luggage is protected. Such an embodiment is particularly effective for loose luggage that must be checked at airports. Such luggage may be transported outside and could be subject to handling by inattentive personnel. Smaller "carry on luggage" is less likely to be subjected to such conditions. Accordingly, the embodiments of FIGS. 1–6 will usually be acceptable for protecting such items. It should be understood, however, that all of the embodiments of this invention are capable of accommodating luggage of various shapes and sizes.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A protective shell for a piece of luggage comprising:

a pair of substantially rigid, transparent shell sections, each having an interior space, which at least partially accommodates said piece of luggage;

means for pivotably interconnecting said shell sections such that said shell sections are pivotable between an open condition to expose said interior space of each shell section and a closed condition to define an enclosure about said interior spaces for accommodating said piece of luggage therein;

means for provisionally fastening said shell sections in the closed condition; and means for adapting said shell to be carried by a person using said shell.

2. The shell of claim 1 in which said luggage has a carrying handle attached thereto and said mean of adapting includes slot means formed in at least one of said shell sections for receiving said handle therethrough such that said handle is accessible to the person using said shell.

3. The shell of claim 1 in which said luggage has a carrying shoulder strap and said means for adapting includes first and second spaced apart openings, each formed in at least one of said shell sections for receiving respective segments of said strap therethrough such that said strap is accessible to a person carrying said shell.

4. The shell of claim 1 in which each said shell section comprises a unitary structure.

5. The shell of claim 1 in which said means for adapting include a handle that is attached to at least one of said shell sections.

6. A protective shell for a piece of luggage having a handle attached thereto, said shell comprising:

first and second substantially rigid, transparent shell sections, each having a relatively broad side portion and elongate top, bottom, front and rear portions, which are attached to and extend longitudinally about the periphery of said side portion and which extend laterally from said side portion to define an interior space in said shell section for at least partially receiving said piece of luggage;

means for pivotably interconnecting said respective bottom portions of said shell sections such that said shell sections are pivotable between an open condition wherein said top, front and rear portions of said first shell section are disengaged from said top, front and rear portions, respectively, of said second shell section to expose said interior space of each shell section and a closed condition wherein said top, front and rear portions of said first shell section are engaged with said top, front and rear portions, respectively, of said second shell section to define an enclosure for accommodating said piece of luggage;

means for provisionally fastening said shell sections in the closed condition; and slot means formed in at least one of said top portions for receiving, when said shell sections are closed, the handle of the piece of luggage accommodated by said shell sections.

7. The shell of claim 6 in which each shell section comprises a unitary structure wherein said side, top, bottom, front and rear portions are integrally interconnected.

8. The shell of claim 6 in which said slot means include a first recessed portion formed in said top portion of said first shell section and a second complementary recessed portion formed in said top portion of said second shell section, which recessed portions are interengaged when said shell sections are closed.

9. The shell of claim 6 further including a first opening formed in at least one of said top portions proximate a first end thereof and a second opening formed in at least one of said top portions proximate a second end thereof for receiving respective segments of a luggage carrying strap therethrough.

10. The shell of claim 9 in which each of said first and second openings include a primary recessed portion formed in said top section of said first shell section and a secondary complementary recessed portion formed in said top portion of said second shell section, which primary and secondary recessed sections are interengaged when said shell sections are closed.

11. A protective shell for a piece of luggage, said shell comprising:

first and second substantially rigid, transparent shell sections, each having a relatively broad side portion and elongate top, bottom, front and rear portions, which are attached to and extend longitudinally about the periphery of said side portion and which extend laterally from said side portion to define an interior space in said shell section for at least partially receiving said piece of luggage;

means for pivotably interconnecting said respective bottom portions of said shell sections such that said shell sections are pivotable between an open condition wherein said top, front and rear portions of said first shell section are disengaged from said top, front and rear portions, respectively, of said second shell section to expose said interior space of each shell section and a closed condition wherein said top, front and rear portions of said first shell section are engaged with said top, front and rear portions, respectively, of said second shell section to define an enclosure for accommodating said piece of luggage;

means for provisionally fastening said shell sections in the closed condition; and a handle that is attached to at least one of said shell sections.

* * * * *